US010477959B2

(12) United States Patent
Dengler et al.

(10) Patent No.: US 10,477,959 B2
(45) Date of Patent: Nov. 19, 2019

(54) BRUSH HEAD MANUFACTURING METHODS

(71) Applicant: KONINKLIJKE PHILIPS N.V., Eindhoven (NL)

(72) Inventors: Evan Dak Wah Dengler, Seattle, WA (US); Gregory Russ Goddard, Kenmore, WA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 324 days.

(21) Appl. No.: 15/127,948

(22) PCT Filed: Mar. 24, 2015

(86) PCT No.: PCT/IB2015/052134

§ 371 (c)(1),
(2) Date: Sep. 21, 2016

(87) PCT Pub. No.: WO2015/145342

PCT Pub. Date: Oct. 1, 2015

(65) Prior Publication Data

US 2017/0095322 A1 Apr. 6, 2017

Related U.S. Application Data

(60) Provisional application No. 62/025,039, filed on Jul. 16, 2014, provisional application No. 62/008,762,
(Continued)

(51) Int. Cl.
*A47D 3/00* (2006.01)
*A46B 3/06* (2006.01)
(Continued)

(52) U.S. Cl.
CPC ..... *A46D 3/005* (2013.01); *A46B 3/00* (2013.01); *A46B 3/04* (2013.01); *A46B 3/06* (2013.01);
(Continued)

(58) Field of Classification Search
CPC . A46D 3/00; A46D 3/005; A46D 3/04; A46D 3/045; A46B 3/00; A46B 3/005;
(Continued)

(56) References Cited

U.S. PATENT DOCUMENTS 5,474,366 A 12/1995 Struitt et al.
5,802,656 A 9/1998 Dawson et al.
(Continued)

FOREIGN PATENT DOCUMENTS

CN 1176582 A 3/1998
DE 1457055 9/1970
(Continued)

*Primary Examiner* — Mark Spisich

(57) ABSTRACT

A method (200) for manufacturing a brush head (100). The method includes the steps of providing a plurality of polypropylene bristle tuft retention rings (50), and inserting a respective nylon bristle tuft (21) into each of the bristle tuft retention rings. Heat is applied to each bristle tuft proximal end (23) at a temperature sufficient to at least partially melt the bristle tuft proximal end and create a proximal head portion (26). The platen (42) of the brush head is positioned in relation to the retaining rings (50) and proximal head portions (26) to define a space (92) in relation to the proximal head portions for injection of a thermoplastic elastomer, and the thermoplastic elastomer is injected into the space to create an elastomeric matrix (30) that at least partially encompasses the neck and the proximal head portions.

14 Claims, 9 Drawing Sheets

Related U.S. Application Data filed on Jun. 6, 2014, provisional application No. 61/974,760, filed on Apr. 3, 2014, provisional application No. 61/970,157, filed on Mar. 25, 2014, provisional application No. 61/970,011, filed on Mar. 25, 2014, provisional application No. 61/970,076, filed on Mar. 25, 2014, provisional application No. 61/970,169, filed on Mar. 25, 2014.

(51) Int. Cl.

| | |
|---|---|
| ***A46B 3/04*** | (2006.01) |
| ***A46B 7/06*** | (2006.01) |
| ***A46B 3/20*** | (2006.01) |
| ***A46B 9/04*** | (2006.01) |
| ***A46D 3/00*** | (2006.01) |
| ***A46B 5/00*** | (2006.01) |
| ***A46B 9/00*** | (2006.01) |
| ***A46B 3/00*** | (2006.01) |

(52) U.S. Cl.

CPC ..... *A46B 3/20* (2013.01); *A46B 5/0029* (2013.01); *A46B 7/06* (2013.01); *A46B 9/00* (2013.01); *A46B 9/04* (2013.01); *A46D 3/00* (2013.01); *A46B 2200/1066* (2013.01)

(58) Field of Classification Search

CPC .... A46B 3/02; A46B 3/04; A46B 3/06; A46B 3/20; A46B 7/00; A46B 7/06; A46B 9/04

USPC ..... 300/21; 15/167.1, 191.1, 192, 193, 201

See application file for complete search history.

(56) References Cited

U.S. PATENT DOCUMENTS

| | | | | | |
|---|---|---|---|---|---|
| 5,991,959 | A | * | 11/1999 | Raven ..... | A46B 7/06 15/167.1 |
| 8,069,524 | B2 | | 12/2011 | Kraemer | |

FOREIGN PATENT DOCUMENTS

| | | | | |
|---|---|---|---|---|
| DE | 10303548 | | * | 8/2004 |
| DE | 102005029366 | | * | 1/2007 |
| DE | 102009009034 | A1 | | 8/2010 |
| DE | 102009058608 | | * | 6/2011 |
| JP | 7-148019 | | * | 6/1995 |
| JP | 3131630 | U | | 4/2007 |
| WO | 9626658 | A1 | | 9/1996 |
| WO | 9812948 | A1 | | 4/1998 |
| WO | 98/43514 | | * | 10/1998 |
| WO | 03/017801 | | * | 3/2003 |
| WO | 2004080238 | A1 | | 9/2004 |
| WO | 2005/107522 | | * | 11/2005 |
| WO | 2007124941 | A1 | | 11/2007 |
| WO | 2013124422 | A1 | | 8/2013 |
| WO | 2013124424 | A1 | | 8/2013 |

* cited by examiner

BRUSH HEAD MANUFACTURING METHODS

CROSS-REFERENCE TO PRIOR APPLICATIONS

This application is the U.S. National Phase application under 35 U.S.C. § 371 of International Application No. PCT/IB2015/052134, filed on Mar. 24, 2015, which claims the benefit of U.S. Provisional Patent Application Nos. 62/025,039, filed on Jul. 16, 2014, 62/008,762, filed on Jun. 6, 2014, 61/974,760, filed on Apr. 3, 2014, 61/970,157, filed on Mar. 25, 2014, 61/970,011, filed on Mar. 25, 2014, 61/970,076, filed on Mar. 25, 2014, 61/970,169, filed on Mar. 25, 2014. These applications are hereby incorporated by reference herein.

FIELD OF THE INVENTION

The present disclosure is directed generally to methods for manufacturing a brush head assembly with bristle tufts retained within an elastomeric matrix.

BACKGROUND

The brush heads of both manual and power toothbrushes comprise bristles which are used to clean the teeth, tongue, and cheeks. In some toothbrushes, the bristles are organized into bristle tufts contained within retention rings. The retention rings serve to secure the bristle tufts within the brush head, and often have a hollow circular shape with an interior and exterior circular circumference. During manufacture, the bristle tufts are inserted into the hollow interior of the retention ring, and the bristles in the retention ring are then secured into a brush head material which is then cooled or allowed to cool in order to form the final brush head.

Often, however, the retention rings are not firmly secured within the brush head. As a result, the ring and bristle tuft can be or become loose within the brush head, and the bristles might not always be positioned at an angle optimal for brushing. As such, under the dynamic conditions of motion induced by the power toothbrush operation, for example, the retention rings tend to separate from the brush head. Further, the process of organizing the bristles into tufts within the retention rings and then cooling the brush head material, or allowing it to cool, in order to fix the tufts in place can be time-consuming and expensive.

Accordingly, there is a need in the art for methods and apparatus for permanently efficiently retaining bristle tufts within a brush head.

SUMMARY OF THE INVENTION

The present disclosure is directed to inventive methods for manufacturing a brush head with secured bristle tufts. Various embodiments and implementations herein are directed to manufacturing methods in which bristle tufts are affixed with or to retention rings and are then embedded within an elastomeric matrix resulting in a completed brush head. Using the various embodiments and implementations herein, cost-effective and efficient production of brush heads with secured bristle tufts is substantially improved.

For example, in some embodiments, the manufacturing method includes inserting a tuft of bristles into a retention ring and then securing the tuft of bristles to the retention ring, securing the retention ring to the tuft of bristles, and/or forming a retaining head portion on the tuft of bristles which is unable to pass through the retaining ring. The shape of the retaining ring and the relationship between the retaining ring and the bristle tuft can be configured to minimize movement of the bristle tuft during use, or to allow only certain movements of the bristle tuft during use.

Other embodiments can include an elastomeric matrix formed from at least a first layer and a second layer, where the first layer and the second layer are made from materials with different elastic modulus values. Further, using the various embodiments and implementations herein, including, but not limited to incorporating layers in the elastomeric matrix with different elastic modulus values and providing other configurations of the matrix to allow for varied purposeful mobility of bristle tufts/flexibility of the elastomeric matrix, improved and more complete teeth cleaning can be achieved.

The brush heads disclosed and described herein can be used with any manual or power toothbrush device. One example of a power toothbrush device that the brush head can be used with Sonicare® devices available from Koninklijke Philips Electronics N.V. This oral care device is based upon an actuator with a reciprocating brush head including bristles to provide an effective cleaning of a user's teeth.

Generally in one aspect, a method for manufacturing a brush head includes the steps of: (i) providing a plurality of polypropylene bristle tuft retention rings with non-circular exterior walls; (ii) inserting a respective nylon bristle tuft into each of the bristle tuft retention rings; (iii) applying heat to each bristle tuft proximal end at a temperature sufficient to at least partially melt the bristle tuft proximal end and create a proximal head portion; (iv) positioning a platen portion of the neck of the brush head in relation to the proximal head portions, where the positioning of the platen portion of the neck defines a space in relation to the proximal head portions for injection of a thermoplastic elastomer; and (v) injecting the thermoplastic elastomer into the space to create an elastomeric matrix that at least partially encompasses the platen and the proximal head portions.

In accordance with an embodiment each of the plurality of retention rings includes an interior wall, where the interior wall and exterior wall of each retention ring can be of different shapes. The shape of the interior wall is generally circular in shape, and the shape of the exterior wall of each retention ring is generally non-circular in shape. The non-circular shape can be, for example, triangular, square, pentagonal, hexagonal, heptagonal, octagonal, nonagonal, or decagonal.

In accordance with an embodiment, the step of applying heat comprises applying heated air, radiation, and/or heat conduction, among other methods.

In accordance with an embodiment, the plurality of bristle tuft retention rings are at least partially interconnected by a network of webbing links. In accordance with an embodiment, the network of webbing links is at least partially encompassed within the elastomeric matrix during said injecting step.

In accordance with an embodiment, the neck includes a gate for injection of said thermoplastic elastomer into said space.

Generally, in one aspect, a method for manufacturing a brush head includes the steps of: (i) providing a plurality of polypropylene bristle tuft retention rings having a non-circular exterior wall; (ii) inserting a respective nylon bristle tuft into each of the bristle tuft retention rings; (iii) affixing a proximal end of each bristle tuft to its respective bristle tuft retention ring; (iv) positioning a platen portion of the neck of the brush head in relation to the bristle tuft proximal ends, where the positioning of the platen portion of the neck defines a space in relation to the bristle tuft proximal ends for injection of a thermoplastic elastomer; and (v) injecting the thermoplastic elastomer into the space to create an elastomeric matrix that at least partially encompasses the platen and the bristle tuft proximal ends.

In accordance with an embodiment, each of the plurality of retention rings has an interior wall, where the interior wall and exterior wall of each retention ring are of different shapes.

In accordance with an embodiment, the plurality of bristle tuft retention rings are at least partially interconnected by a network of webbing links. In accordance with an embodiment, the network of webbing links is at least partially encompassed within the elastomeric matrix during said injecting step.

In accordance with an embodiment, the elastomeric matrix includes at least a first layer and a second layer, wherein the first layer is closer to the first surface of the elastomeric matrix as compared to the second layer, and the first layer and the second layer are made from materials with different elastic modulus values.

Generally, in one aspect, a method for manufacturing a brush head includes the steps of: (i) providing a plurality of nylon bristle tufts, each having a proximal end; (ii) applying heat to each bristle tuft proximal end at a temperature sufficient to at least partially melt the bristle tuft proximal end and create a proximal head portion; (iii) providing a polypropylene bristle tuft retention ring having a non-circular exterior wall around the proximal end of each respective bristle tuft adjacent to the proximal head portion; (iv) positioning a platen portion of the neck of the brush head in relation to the proximal head portions, wherein the positioning of the platen portion of the neck defines a space in relation to the proximal head portions for injection of a thermoplastic elastomer; and (v) injecting the thermoplastic elastomer into the space to create an elastomeric matrix that at least partially encompasses the platen and the proximal head portions.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of a method for manufacturing a brush head assembly with bristle tufts retained within an elastomeric matrix. More generally, Applicants have recognized and appreciated that it would be beneficial to provide a brush head formed from an elastomeric matrix and including retention rings. For example, bristle tuft packing placement can restrict or enhance movement of a flexible elastomeric matrix, which can be beneficial to a brush head's function, especially in powered toothbrush devices. A particular goal of utilization of certain embodiments of the present disclosure is the ability to efficiently manufacture brush heads with improved retention of the retention ring and the bristle tuft.

In view of the foregoing, various embodiments and implementations are directed to a method in which a bristle tuft is affixed to or within a retention ring and is then embedded within an elastomeric matrix. The bristle tuft is inserted into the retention ring and is secured to the retention ring. Alternatively, the retention ring is secured around the bristle tuft. As yet another alternative, a retaining head portion is created on the bristle tuft which is then unable to pass through the retaining ring. The bristle tuft and retaining ring are then embedded within an elastomeric matrix to form the brush head.

Brush Head Assembly

Figure 1:
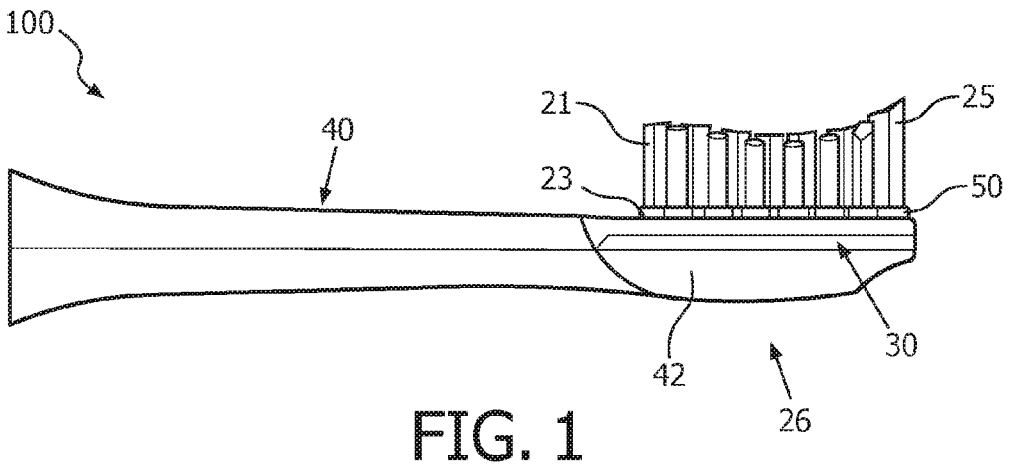
FIG. 1 is a schematic representation of a side view of a brush head assembly in accordance with an embodiment.

Referring to FIG. 1, in one embodiment, a schematic representation of a brush head assembly 100 is provided. The brush head includes a neck 40, which can be coupled to any manual brush shaft, or, more preferably, to any actuator and drive shaft (not shown) made or suitable for oral care devices now known or to be developed. The brush head also includes a plurality of bristle tufts 21, each of which comprises a plurality of bristle strands. According to an embodiment, the bristle tufts are composed of nylon, or another suitable material. Each bristle tuft includes a proximal end 23 and a free end 25, where the proximal end of each bristle tuft is retained within the brush head assembly 100. According to an embodiment, each bristle tuft 21 is retained within a retention ring 50. The proximal end of the bristle tuft and the retention rings and the portion of the neck that is the platen 42 are retained within a flexible elastomeric matrix 30 to form a head portion 26 of the brush head assembly 100. According to an embodiment, the elastomeric matrix 30 is preferably made from a flexible thermoplastic elastomer (TPE), and the retention rings are preferably made from thermoplastic polymer such as polypropylene. Each of the neck 40, platen 42, and the retention rings 50 is preferably made from a material with a higher elastic modulus value than the elastomeric matrix 30.

Figure 2:
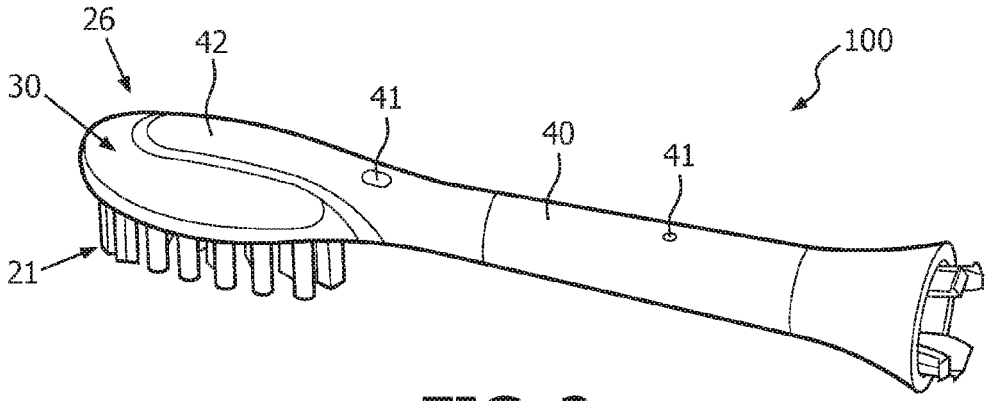
FIG. 2 is a schematic representation of a reverse view of a brush head assembly in accordance with an embodiment.

Referring to FIG. 2, in one embodiment, a reverse schematic representation of a brush head assembly 100 is provided. One or more gates 41 is shown on the back side of the neck 40. This gate 41 is used for the injection molding of the elastomeric matrix 30, as described below.

Figure 3:
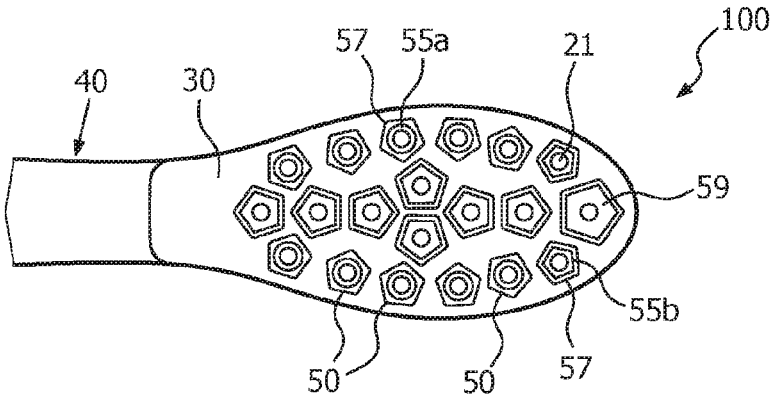
FIG. 3 is a schematic representation of a front view of a brush head assembly in accordance with an embodiment.

Referring to FIG. 3, in one embodiment, a schematic representation of a brush head assembly 100 is provided. In this figure, retention rings 50 are shown embedded in the elastomeric matrix 30. Retention rings 50 can comprise a wide variety of different shapes and sizes. The retention rings comprise an exterior wall 57 and an interior wall 55, and defines an interior space 59. Bristle tufts 21 can be seen inside the retention rings 50. According to an embodiment, the geometric shape of exterior wall 57 can differ from the geometric shape of interior wall 55. For example, as shown in FIG. 3, the geometric shape of the exterior wall 57 of the retention rings is pentagonal, while the geometric shape of interior wall 55*a* is circular. According to another embodiment, the geometric shape of the exterior wall 57 can be the same as the geometric shape of interior wall 55*b*. An embodiment contemplates all other non-circular shapes (i.e., shapes with angles) for the interior wall shape and/or the exterior wall shape of any retention ring (including, but not limited to, triangular, square, pentagonal, hexagonal, heptagonal, octagonal, nonagonal, and decagonal etc.). An embodiment also contemplates arrangements of individual retention rings in an elastomeric matrix 30 with any combination of interior wall 55 and exterior wall 57 shape combinations (e.g., circular and non-circular; or two different non-circular shapes such as pentagonal and triangular, respectively), and a variety of any combination of interior space 59 area sizes.

Many other embodiments of brush head assembly 100 are possible, including other configurations of neck 40, platen 42, bristle tufts 21, retention rings 50, and/or elastomeric matrix 30.

Methods of Brush Head Manufacture

Figure 4:
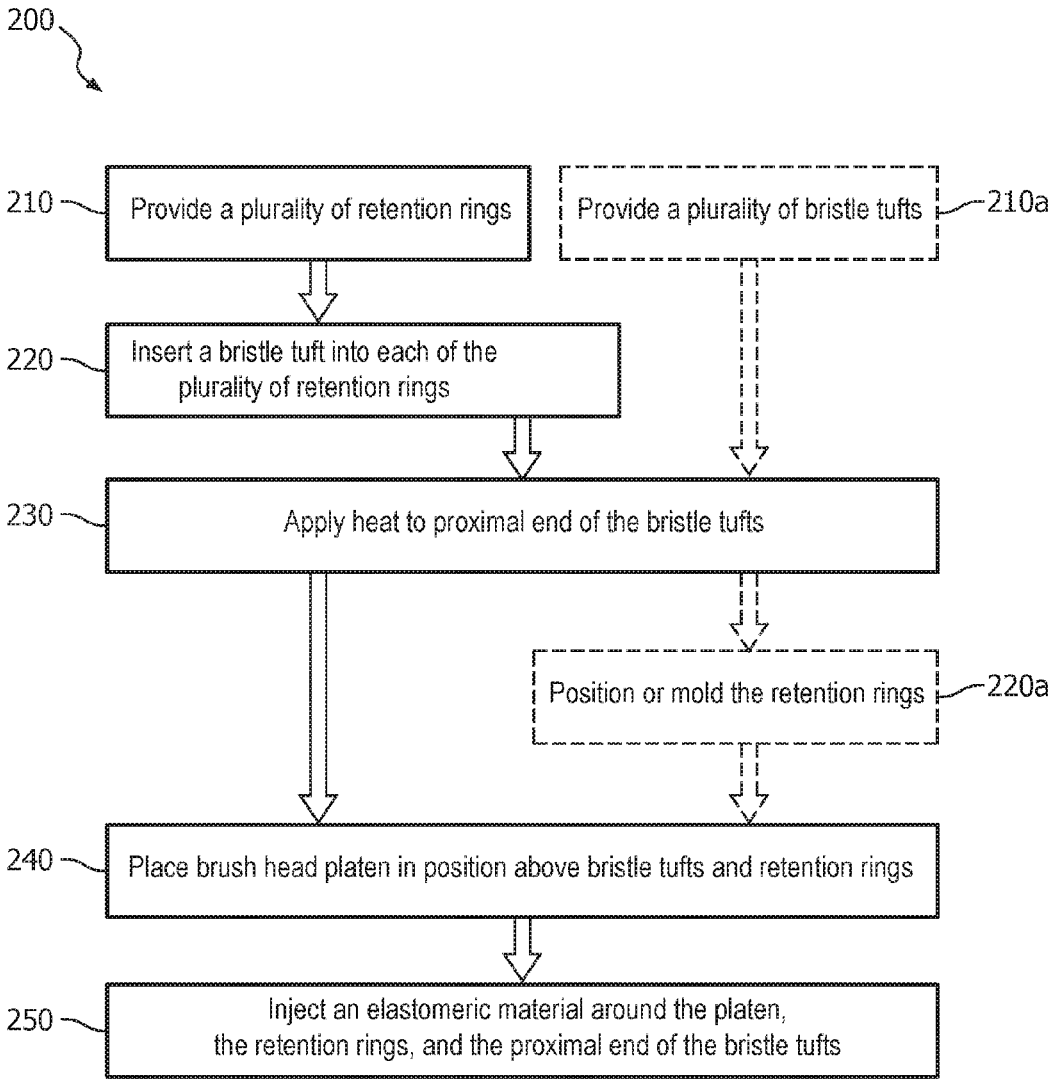
FIG. 4 is a flowchart of a method for manufacturing a brush head assembly with bristle tufts retained within an elastomeric matrix in accordance with an embodiment.
Figure 5A:
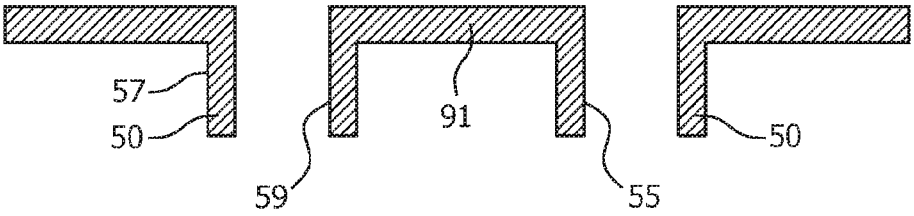
FIGS. 5A-5E are schematic representations of a method for manufacturing a brush head assembly with bristle tufts retained within an elastomeric matrix in accordance with an embodiment.

Referring to FIG. 4, in one embodiment, is a method 200 for manufacturing one or more of the various brush head embodiments and implementations described or otherwise envisioned herein. In step 210 of the method of manufacture depicted in FIG. 4, a plurality of retention rings 50 are provided, as shown in FIG. 5A. In this side view schematic, each of the retention rings includes an interior wall 55 forming an interior space 59 and an exterior wall 57. Retention rings 50 can be any of the shapes, sizes, and/or configurations described or otherwise envisioned herein. For example, the plurality of retention rings 50 can be the same size and shape, or multiple different sizes and shapes. In the embodiment depicted in FIG. 5A, two or more of the plurality of retention rings 50 are connected or at least partially interconnected by a webbing or network of webbing links 91 to improve retention ring and bristle tuft retention within the brush head, although a webbing link 91 is not necessary, and a plurality of individual retention rings 50 can be used. According to an alternative embodiment, for example, the plurality of retention rings 50 can be held in place by a tuft ring, or by some other support mechanism. The tuft ring or other support mechanism can be removed prior to one or more downstream steps, or can form part of the completed brush head assembly.

Figure 5B:
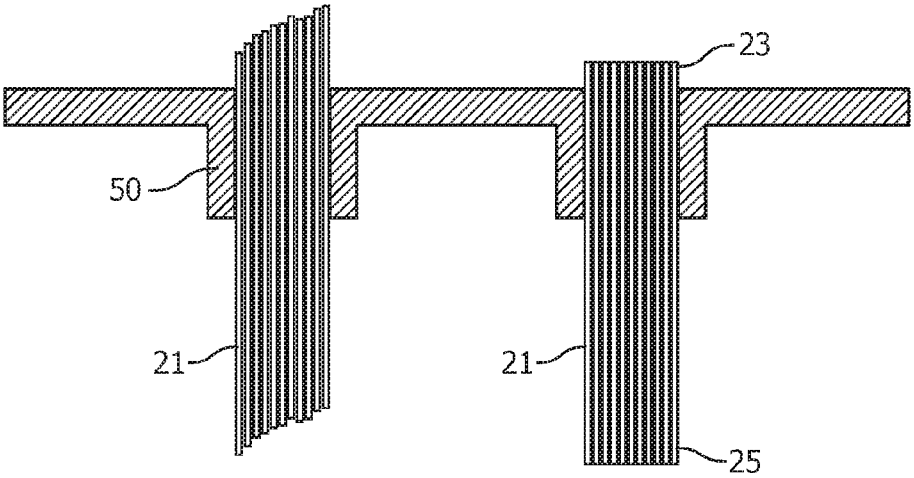

At step 220 of the method, a bristle tuft 21 (which comprises a plurality of bristle strands) is inserted into each of the plurality of retention rings 50. As shown in FIG. 5B, for example, each of the bristle tufts 21 includes a proximal end 23 and a free end 25, with the proximal end being inserted into the retention ring.

Figure 5C:
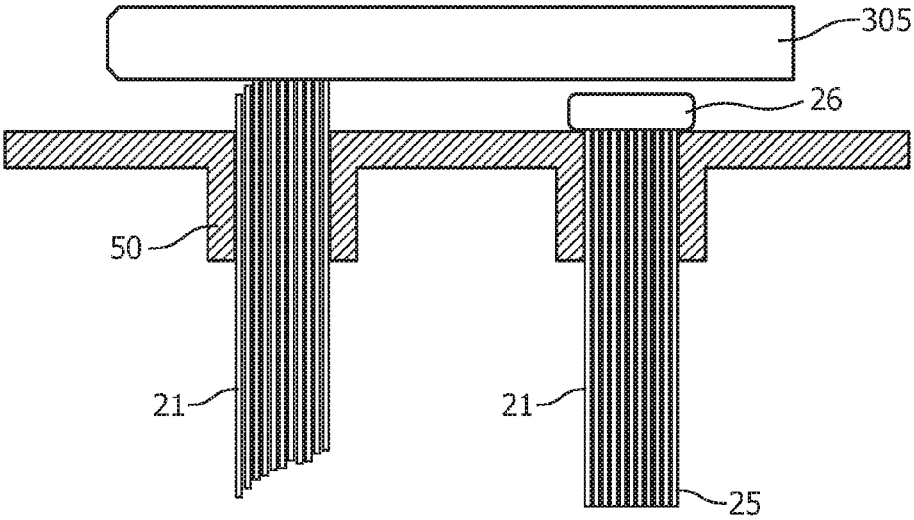

At step 230 of the method, heat is applied to the proximal end 23 of the plurality of bristle tufts 21 to create a proximal end head portion 26. Proximal end head portion 26 is the melted ends of the bristle tuft 21. In FIG. 5C, for example, the heat is supplied by a heat source 305 that comes into direct physical contact with the proximal end 23 of the bristle tufts. In addition to heat source 305, the heat can be supplied by heated air or any of a variety of other heat sources. Note that in some embodiments, the heating of the proximal end 23 of the plurality of bristle tufts 21 can be done in conjunction with step 250, below, depending on the chemical composition, and therefore the melting point, of the bristle tufts 21, and elastomeric matrix 30.

According to an embodiment, the heat applied at step 230 of the method is sufficiently hot enough and/or sufficiently long enough to also melt, at least partially, the retention ring 50 to the bristle tuft. This would further prevent individual bristles within bristle tuft 21 from escaping or moving around inside the retention ring.

Figure 5D:
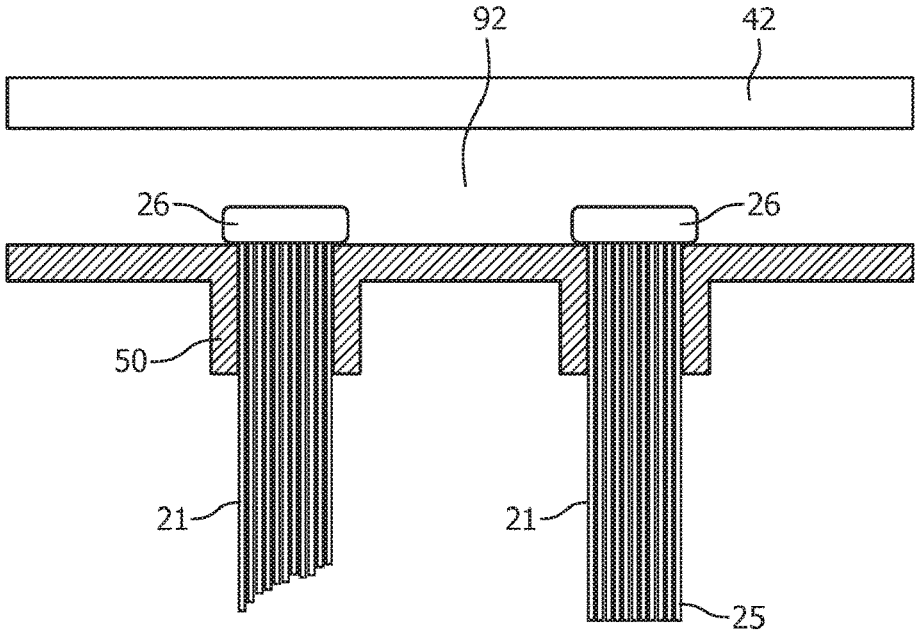

In step 240 of method 200 depicted in FIG. 4, the brush head neck 40 is positioned to put the platen 42 in the proper location in relation to the retaining rings 50 with the bristle tufts 21 inserted, and the webbing links 91. As shown in FIG. 5D, for example, platen 42 is positioned just above head portion 26 of the bristle tufts 21 in the retaining rings 50. Platen 42 can be properly positioned using a mold, for example, or other positioning mechanism. This creates a space 92 into which an elastomeric material can be injected, as shown in FIG. 5D.

Figure 5E:
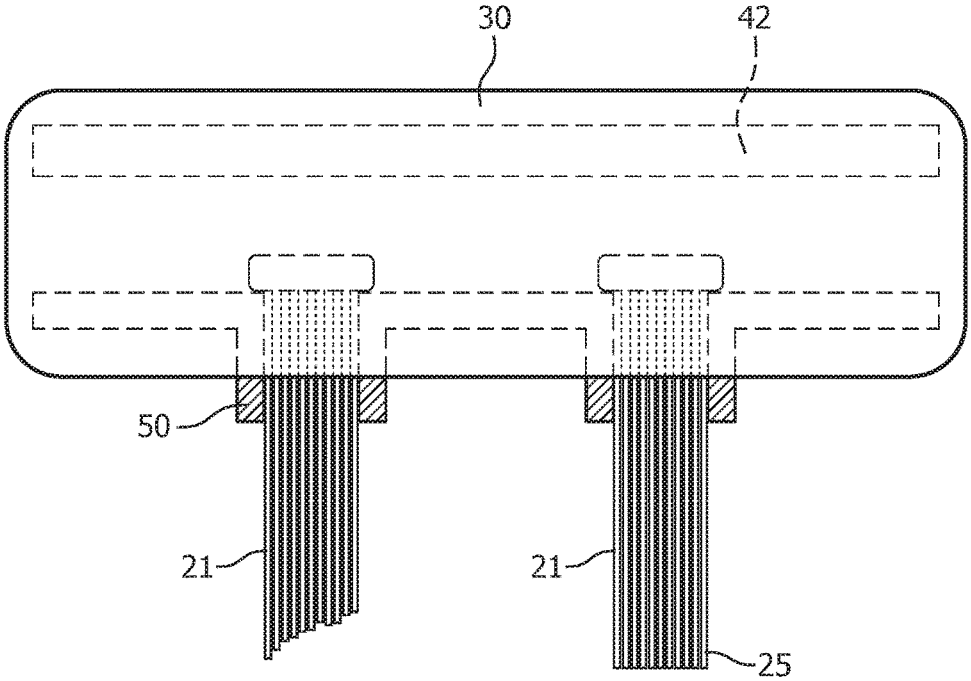

In step 250 of the method, an elastomeric material is molded into the space 92 over the platen 42, the head portion 26 of the bristle tufts, and the retaining rings 50, as well as the webbing links 91 if they are present. The molded elastomeric material forms an elastomeric matrix 30, as shown in FIG. 5E. According to an embodiment, elastomeric matrix 30 is preferably made from a flexible thermoplastic elastomer, while the retaining rings are preferably made from thermoplastic polymer such as polypropylene. According to this embodiment, each of the platen 42 and the retaining rings 50 is made from a material with a higher elastic modulus than the elastomeric matrix 30. According to an embodiment (not shown), neck 40 and platen 42 of the brush head is inserted into a mold and blocks the egress of the elastomeric material from the mold cavity. As shown in FIG. 2, neck 40 comprises one or more gates 41 which allows the molten elastomeric material to be injected into the cavity of the mold.

According to another embodiment of method 200, depicted in dotted lines in FIG. 4, steps 210, 220, and 230 are altered. In this embodiment, the retaining rings 50 have a higher melting temperature than bristle tufts 21. For example, if nylon is used for the bristle tufts, the melting temperature is approximately 213° C. A higher temperature material is then used for the retaining rings 50, such as polyether ether ketone, which has a melting temperature of approximately 343° C. Many other polymers are possible for the bristle tufts and the retaining rings, as long as the melting temperature disparity is properly configured. According to this embodiment, the bristle tufts are first properly positioned at alternative step 210*a*, and the proximal ends of the bristles are melted to form head portion 26 at step 230. Then, the retaining rings 50 are positioned or formed, such as molding, around the positioned bristle tufts 21 in alternative step 220*a*. For example, the retaining rings can be molded, inserted, or otherwise formed around the positioned bristle tufts. This allows the bristles to fuse and bond directly to the retaining rings, for example.

At an optional step of the method, not shown, after the brush head has been completely assembled, the free end 25 of one or more of the inserted bristle tufts 21 can be trimmed in order to provide a particular free end profile.

Figure 6:
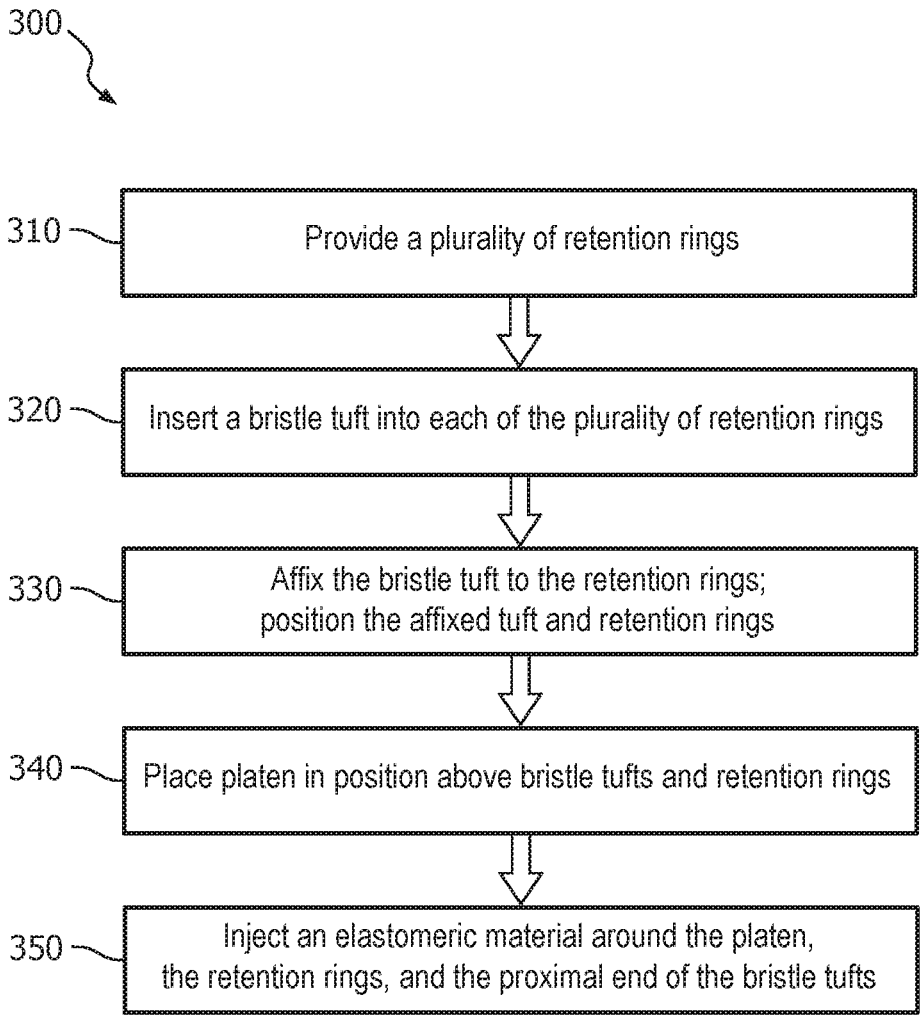
FIG. 6 is a flowchart of a method for manufacturing a brush head assembly with bristle tufts retained within an elastomeric matrix in accordance with an embodiment.

Referring to FIG. 6, in one embodiment, is a method 300 for manufacturing one or more of the various brush head embodiments and implementations described or otherwise envisioned herein. In step 310 of the method of manufacture depicted in FIG. 6, a plurality of retention rings 50 are provided, as shown in FIG. 5A. At step 320 of the method, a bristle tuft 21 (which comprises a plurality of bristle strands) is inserted into each of the plurality of retention rings 50. As shown in FIG. 5B, for example, each of the bristle tufts 21 includes a proximal end 23 and a free end 25, with the proximal end being inserted into the retention ring.

Figure 7:
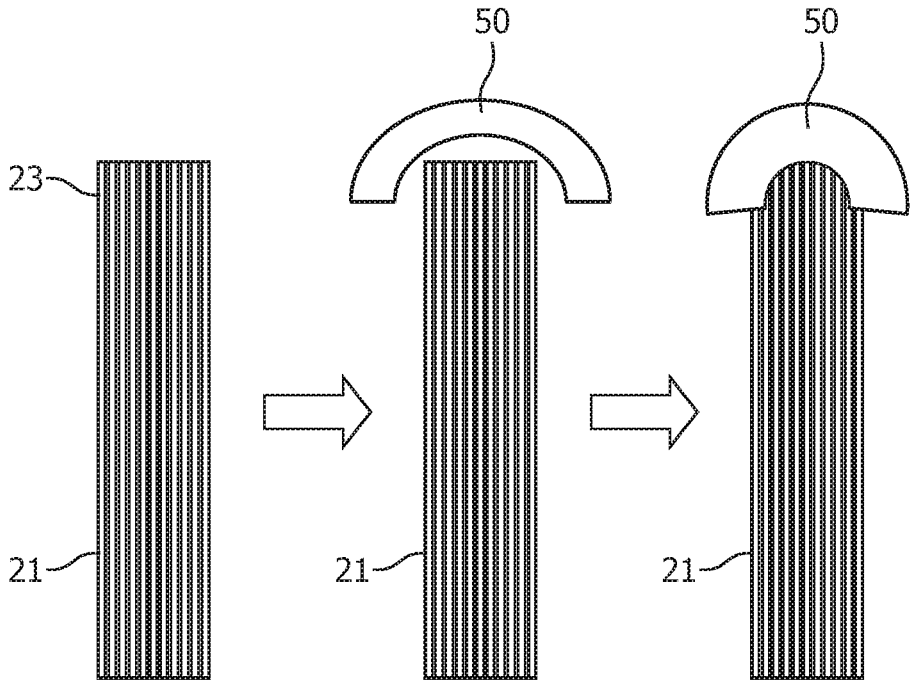
FIG. 7 is a schematic representation of a retention member thermally tightening around the end of a bristle tuft in accordance with an embodiment.
Figure 8:
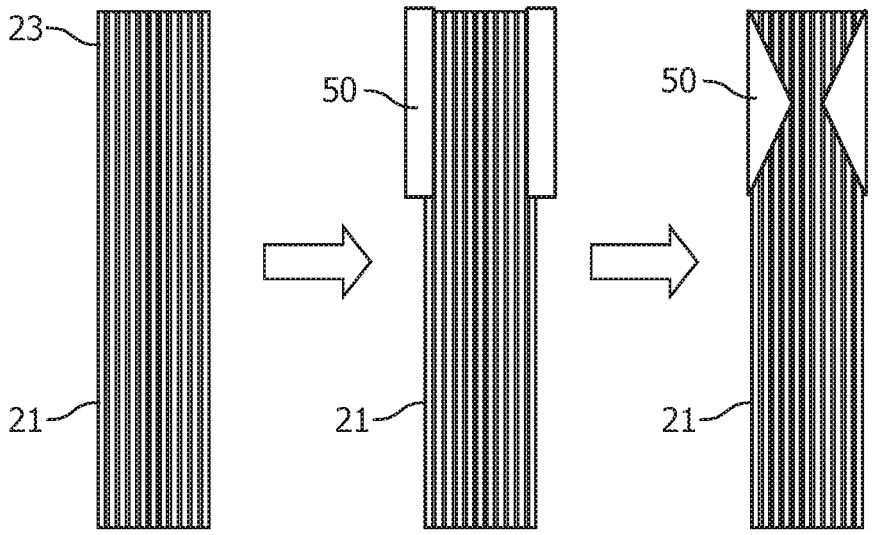
FIG. 8 is a schematic representation of a retention member tightening around the end of a bristle tuft in accordance with an embodiment.

At step 330 of the method, the bristle tufts 21 and the retention rings 50 are affixed or attached to one another. This attachment occurs through one of a wide variety of mechanisms. According to one embodiment, as depicted in FIG. 7, a bristle tuft 21 is formed and a retention ring 50 is placed on or at least partially around the proximal end of the bristle tuft. Heat is applied to the retention ring, which causes thermal shrinking of the retention ring over the proximal end of the bristle tuft. According to another embodiment, as depicted in FIG. 8, a bristle tuft 21 is formed and a retention ring 50 is placed around the proximal end of the bristle tuft. The retention ring is then pinched, shrunk, or squeezed to cause a distortion of the retention ring around the proximal end of the bristle tuft, thereby retaining the bristles in place.

According to another embodiment, the bristle tuft takes a winding or tortuous path through the retention ring, thereby holding the bristle tuft in place by friction.

Once the bristle tufts and retention rings are affixed to each other and positioned, the method can proceed to step 340 by positioning the brush head platen 42 in the proper location in relation to the bristle tufts 21 in retaining rings 50, and the optional webbing links 91, as shown in FIG. 5D. In step 350 of the method, an elastomeric material is molded over the platen 42, the head portion 26 of the bristle tufts, and the retaining rings 50, as well as the webbing links 91 if they are present.

Figure 9:
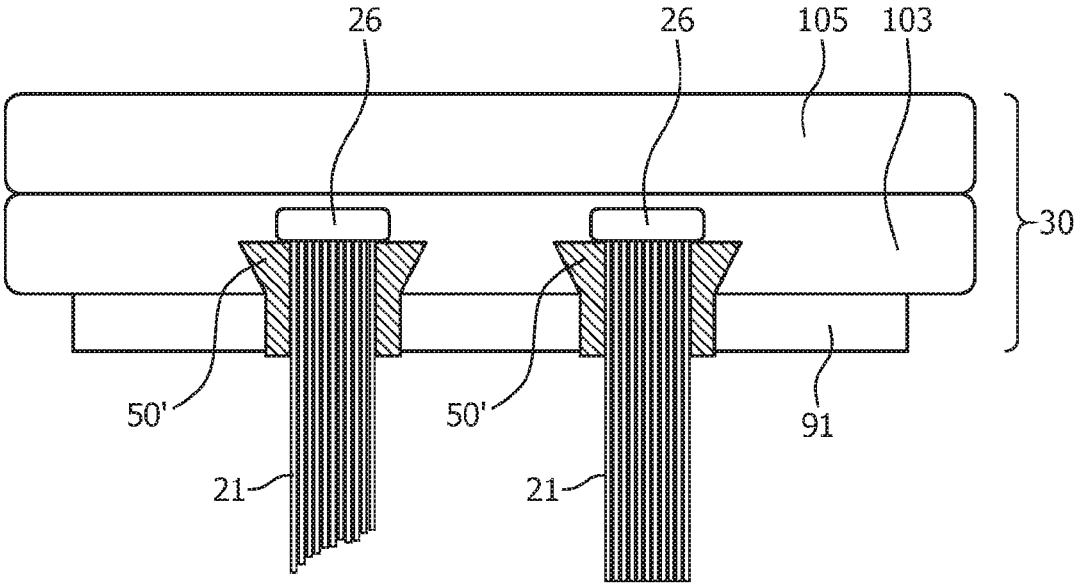
FIG. 9 is a side view schematic representation of two retention rings with bristle tufts retained therein, each of which are secured in an elastomeric matrix with multiple layers in accordance with an embodiment.

According to an embodiment, additional manufacturing methods and designs that can improve bristle tuft retention include multi-layering of materials in the elastomeric matrix 30. This could consist of two or more layers with either the same or varying material properties (including varying elastic modulus values). For example, referring to FIG. 9, in one embodiment, a side view schematic representation of retention rings 50 with bristle tufts 21 retained therein, respectively, each of which includes a head portion 26, is shown. More specifically, retention rings 50 and proximal portions of bristle tufts 21 are shown secured in an elastomeric matrix 30 with multiple layers 103 and 105, and connected by a webbing link 91. In one example, layer 103 can have a relatively lower elastic modulus value as compared with layer 105. Hence, layer 103 could be softer to allow bristle flexibility and experiential benefits, and the stiffer layer 105 could be used to stabilize the brush head 100 and ensure the bristles move sufficiently under a load to provide a better cleaning performance. The opposite configuration—layer 105 with a relatively lower elastic modulus value as compared with layer 103—could be prepared and used to prevent "tooth-chattering," for example. Additional layers are contemplated, which could be made of the same or different materials as compared to other layers.

Figure 10A:
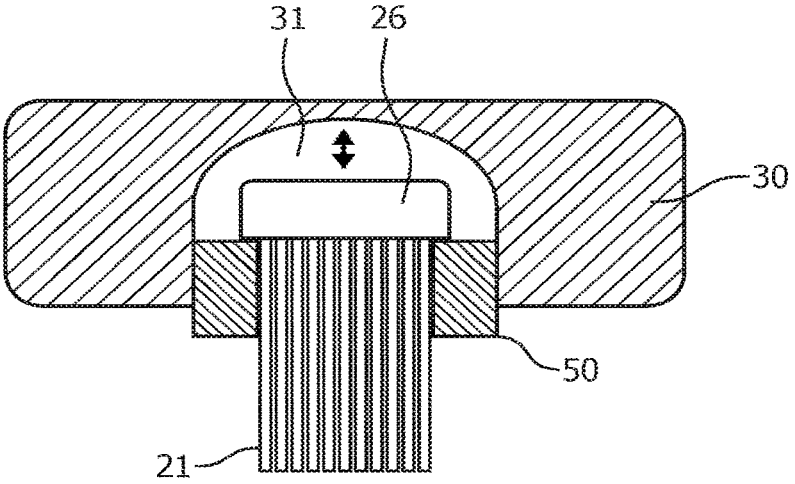
FIG. 10A is a side view schematic representation of a bristle tuft retained at a position within an elastomeric matrix, where the position includes an area void of elastomeric matrix material adjacent to the proximal end of the bristle tuft and within which the proximal end of the first bristle tuft is configured to translate into and out of during use in accordance with an embodiment.
Figure 10B:
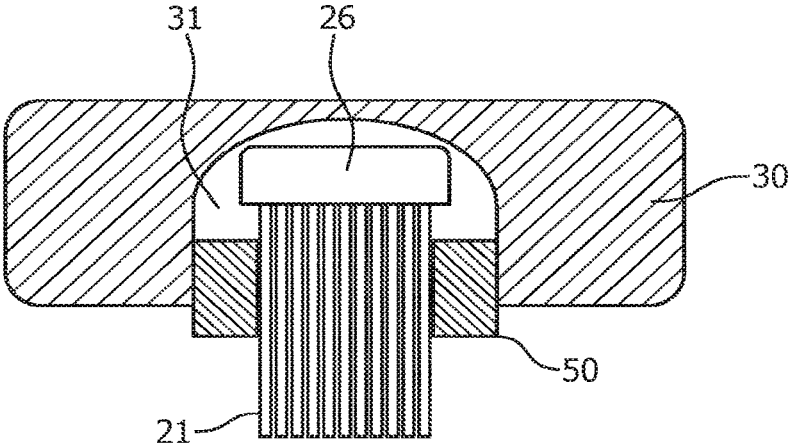
FIG. 10B is a side view schematic representation of a bristle tuft retained at a position within an elastomeric matrix, where the position includes an area void of elastomeric matrix material adjacent to the proximal end of the bristle tuft and within which the proximal end of the first bristle tuft is configured to translate into and out of during use in accordance with an embodiment.

Referring to FIGS. 10A-10B, in additional embodiments, side view schematic representations of a bristle tuft 21 with a head portion 26 retained at a position within an elastomeric matrix 30 by a retention ring 50 are shown, where the position includes an area 31 void of elastomeric matrix material adjacent to the proximal end of the bristle tuft and within which the proximal end of the bristle tuft is configured to translate into and out of during use—similar to a pin cushion (as shown by the double sided arrow in FIG. 10A and the changed position of the bristle tuft 21 within the area 31 between FIGS. 10A and 10B). This configuration can add additional conformity to oral geometries and with a powered brush platform could result in tapping which can provide a massage benefit to a user. This translational movement could also increase reach of the bristle tufts into interproximal areas.

Figure 10C:
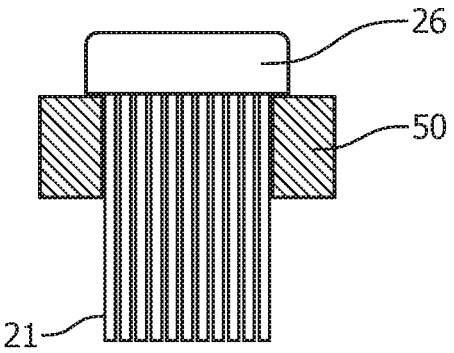
FIG. 10C is a side view schematic representation of part of the formation of the area void of elastomeric matrix material in the elastic matrix as shown in FIGS. 6A-6B in accordance with an embodiment.
Figure 10D:
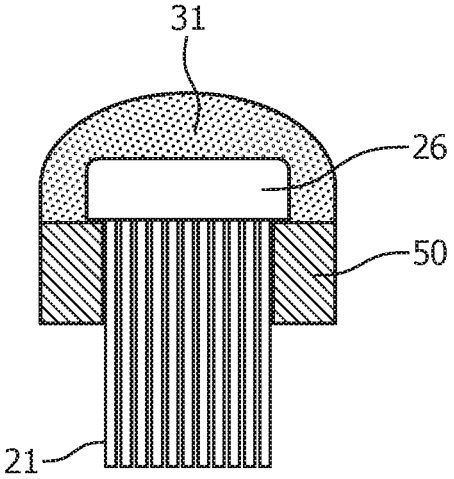
FIG. 10D is a side view schematic representation of part of the formation of the area void of elastomeric matrix material in the elastic matrix as shown in FIGS. 6A-6B in accordance with an embodiment.
Figure 10E:
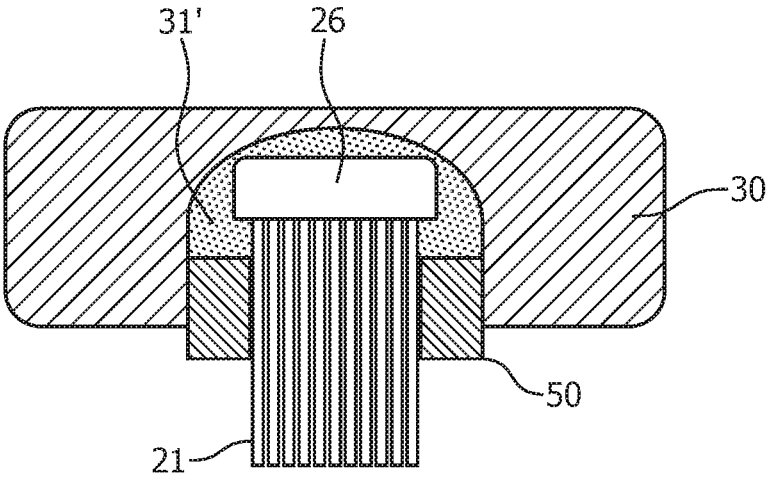
FIG. 10E is a side view schematic representation of part of the formation of the area void of elastomeric matrix material in the elastic matrix as shown in FIGS. 6A-6B in accordance with an embodiment.

Referring to FIGS. 10C-10E, in additional embodiments, side view schematic representations of the formation of the area 31 void of elastomeric matrix material in the elastic matrix 30 as shown in FIGS. 10A-10B (which can be filled with a dissolvable material 31') are shown. More specifically, FIG. 10C shows the formation of the retainer ring 50 with the bristle tuft 21 including the head portion 26 retained therein. FIG. 10D shows the formation of the area 31 void of elastomeric matrix material in the elastomeric matrix 30, which is filled with a dissolvable material 31'. FIG. 10E shows the construct of FIG. 10D within an elastomeric matrix 30. Additional vertical range of motion can be created by increasing the space above the head portion 26 using the dissolvable material 31' followed by a solvent rinse to remove the material 31'. This can be done in manufacturing before a consumer purchases the brush head. Alternatively, the dissolvable material 31' can remain, which can provide additional benefits and functions. For example, it is contemplated that the dissolvable material 31' could be a beneficial material (fluoride containing compound) and could be removed via solvents commonly found in the oral care environment (water, mouthwash, toothpaste, saliva, etc.). Further, the dissolvable material 31' can be a time-delayed material; where the bristles would get looser and looser over time. The time-delayed material could be used as a brush head replacement indicator All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A method for manufacturing a brush head, the method comprising the steps of:

providing a plurality of polypropylene bristle tuft retention rings having an exterior wall that is polygonal, wherein the exterior wall includes a straight taper;

inserting a respective nylon bristle tuft into each of the bristle tuft retention rings;

applying heat to each bristle tuft proximal end at a temperature sufficient to at least partially melt the bristle tuft proximal end and create a proximal head portion;

positioning a platen portion of a neck of the brush head in relation to the proximal head portions, wherein the positioning of the platen portion of the neck defines a space in relation to the proximal head portions for injection of a thermoplastic elastomer; and injecting the thermoplastic elastomer into the space to create an elastomeric matrix that at least partially encompasses the platen, the proximal head portions, and the straight tapers of the polypropylene bristle tuft retention rings.

2. The method of claim 1, wherein each of the plurality of retention rings further comprises an interior wall, wherein the interior wall and exterior wall of each retention ring are of different shapes.

3. The method of claim 2, wherein the shape of the interior wall is generally circular in shape.

4. The method of claim 1, wherein each of the plurality of retention rings further comprises an interior wall, and further wherein the interior wall and the exterior wall of each retention ring are of the same shape.

5. The method of claim 1, wherein the polygonal exterior shape of the retention rings is selected from the group consisting of triangular, square, pentagonal, hexagonal, heptagonal, octagonal, nonagonal, and decagonal.

6. The method of claim 1, wherein the step of applying heat comprises applying heated air.

7. The method of claim 1, wherein the plurality of bristle tuft retention rings are at least partially interconnected by a network of webbing links.

8. The method of claim 7, wherein the network of webbing links is at least partially encompassed within the elastomeric matrix during said injecting step.

9. The method of claim 1, wherein the neck comprises a gate for injection of said thermoplastic elastomer into said space.

10. The method of claim 1, wherein each exterior wall of the plurality of polypropylene bristle tuft retention rings includes a first end including the straight taper and a second end, opposite the first end, and the first end including the straight taper is wider than the second end.

11. A method for manufacturing a brush head, the method comprising the steps of:

providing a plurality of nylon bristle tufts, each comprising a proximal end;

applying heat to each bristle tuft proximal end at a temperature sufficient to at least partially melt the bristle tuft proximal end and create a proximal head portion;

providing a polypropylene bristle tuft retention ring having an exterior wall around the proximal end of each respective bristle tuft adjacent to the proximal head portion, wherein the exterior wall is polygonal and includes a straight taper;

positioning a platen portion of a neck of the brush head in relation to the proximal head portions, wherein the positioning of the platen portion of the neck defines a space in relation to the proximal head portions for injection of a thermoplastic elastomer; and injecting the thermoplastic elastomer into the space to create an elastomeric matrix that at least partially encompasses the platen, the proximal head portions, and the straight tapers of the polypropylene bristle tuft retention rings.

12. The method of claim 11, wherein each of the plurality of retention rings further comprises an interior wall wherein the interior wall and exterior wall of each retention ring are of different shapes.

13. The method of claim 11, wherein each exterior wall of the plurality of polypropylene bristle tuft retention rings includes a first end including the straight taper and a second end, opposite the first end, and the first end including the straight taper is wider than the second end.

14. A method for manufacturing a brush head, the method comprising the steps of:

providing a plurality of polypropylene bristle tuft retention rings having an exterior wall that is polygonal;

inserting a respective nylon bristle tuft into each of the bristle tuft retention rings;

applying heat to each bristle tuft proximal end at a temperature sufficient to at least partially melt the bristle tuft proximal end and create a proximal head portion;

positioning a platen portion of a neck of the brush head in relation to the proximal head portions, wherein the positioning of the platen portions of the neck defines a space in relation to the proximal head portions for injection of a thermoplastic elastomer;

forming an area adjacent to the proximal head portion to be void of elastomeric matrix; and injecting the thermoplastic elastomer into the space and around the area adjacent to the proximal head portions to create an elastomeric matrix that at least partially encompasses the platen and the proximal head portions.

* * * * *